US009305730B2

(12) United States Patent
Sasaki et al.

(10) Patent No.: US 9,305,730 B2
(45) Date of Patent: Apr. 5, 2016

(54) REMOTE CONTROL RELAY

(71) Applicant: PANASONIC INTELLECTUAL PROPERTY MANAGEMENT CO., LTD., Osaka (JP)

(72) Inventors: Tomoaki Sasaki, Mie (JP); Takafumi Imai, Mie (JP)

(73) Assignee: PANASONIC INTELLECTUAL PROPERTY MANAGEMENT CO., LTD, Osaka (JP)

( * ) Notice: Subject to any disclaimer, the term of this patent is extended or adjusted under 35 U.S.C. 154(b) by 0 days.

(21) Appl. No.: 14/606,422

(22) Filed: Jan. 27, 2015

(65) Prior Publication Data

US 2015/0213987 A1 Jul. 30, 2015

(30) Foreign Application Priority Data

Jan. 30, 2014 (JP) ..... 2014-016077

(51) Int. Cl.

| | |
|---|---|
| ***H01F 7/08*** | (2006.01) |
| ***H01H 51/22*** | (2006.01) |
| ***H01H 50/16*** | (2006.01) |
| ***H01H 50/18*** | (2006.01) |
| ***H01H 50/40*** | (2006.01) |

(52) U.S. Cl.

CPC ..... *H01H 51/2209* (2013.01); *H01H 50/163* (2013.01); *H01H 50/18* (2013.01); *H01H 50/40* (2013.01)

(58) Field of Classification Search

CPC ..... H01F 2007/1669
USPC ..... 335/21, 234, 229
See application file for complete search history.

(56) References Cited

U.S. PATENT DOCUMENTS 4,509,026 A * 4/1985 Matsushita ..... H01H 51/2209 335/132
4,604,596 A * 8/1986 Yokoyama ..... H01H 89/10 335/14

(Continued)

FOREIGN PATENT DOCUMENTS

CN 101030507 9/2007
CN 101630567 1/2010

(Continued)

OTHER PUBLICATIONS

Taiwanese Office Action dated Dec. 1, 2015, including search report, issued in corresponding Taiwanese Patent Application No. 104102977 and English translation thereof.

*Primary Examiner* — Alexander Talpalatski
(74) *Attorney, Agent, or Firm* — Greenblum & Bernstein, P.L.C.

(57) ABSTRACT

A polarized electromagnet in a remote control relay includes a pair of armatures into which opposite ends of the plunger in a forward/backward movement direction are respectively inserted and fixed; a yoke to which one of the armatures becomes closer than the other when the plunger is at a stop position; an auxiliary yoke which contacts with one magnetic pole of a permanent magnet whose the other magnetic pole contacting with the yoke, the auxiliary yoke becoming closer to the other of the armatures than the one of the armatures; and a gap maintaining portion for maintaining a gap between the other of the armatures and the auxiliary yoke. When the plunger is at the stop position, the other of the armatures and the auxiliary yoke comes close to each other with the gap, a space is provided between the one of the armatures and the yoke.

3 Claims, 10 Drawing Sheets

(56) References Cited

U.S. PATENT DOCUMENTS

| | | | | | |
|---|---|---|---|---|---|
| 4,730,175 | A * | 3/1988 | Ichikawa | H01H 51/2209 | 335/230 |
| 4,855,701 | A * | 8/1989 | Yokoyama | H01H 89/10 | 335/230 |
| 5,164,693 | A * | 11/1992 | Yokoyama | H01H 9/46 | 335/14 |
| 5,248,951 | A | 9/1993 | Sogabe et al. | | |
| 5,359,305 | A | 10/1994 | Kitamura et al. | | |
| 5,886,601 | A | 3/1999 | Kitamura et al. | | |
| 5,959,519 | A * | 9/1999 | Gobel | H01F 7/1615 | 335/132 |
| 6,337,612 | B1 * | 1/2002 | Kim | H01H 51/2209 | 335/229 |
| 6,404,312 | B1 * | 6/2002 | Comtois | H01F 7/081 | 335/220 |
| 6,836,201 | B1 * | 12/2004 | Devenyi | H01F 7/1816 | 335/229 |
| 2009/0322453 | A1 | 12/2009 | Kawaguchi et al. | | |

FOREIGN PATENT DOCUMENTS

| | | |
|---|---|---|
| JP | 57-099641 | 6/1982 |
| JP | 59-197278 | 11/1984 |
| JP | 04-028131 | 1/1992 |
| JP | 05-109525 | 4/1993 |
| JP | 2007-59843 | 3/2007 |
| JP | 2011-249137 | 12/2011 |
| TW | 238395 | 1/1995 |
| TW | 339445 | 9/1998 |

* cited by examiner

REMOTE CONTROL RELAY

CROSS-REFERENCE TO RELATED APPLICATION

This application claims the benefit of priority of Japanese Patent Application No. 2014-016077, filed on Jan. 30, 2014, the entire contents of which are hereby incorporated by reference.

TECHNICAL FIELD

The present disclosure relates to a remote control relay.

BACKGROUND ART

Conventionally, a latching-type remote control relay is used to remotely control, e.g., an on/off operation of a luminaire.

As for the remote control relay of this kind, there is known a remote control relay including an electromagnetic device 104 which drives a plunger 105 by controlling an electromagnetic coil 106 as shown in FIG. 11 (see, e.g., Japanese Unexamined Patent Application Publication No. 1993-109525).

In the remote control relay disclosed in Japanese Unexamined Patent Application Publication No. 1993-109525, a movable contact point 111 and a fixed contact point 112, both of which constitute a contact point unit of an opening/closing mechanism, make contact to each other or separate from each other in conjunction with the movement of the plunger 105. The electromagnetic device 104 includes a first yoke 108 within which the plunger 105 is movably installed. In the electromagnetic device 104, a spacer 131*a* is provided on a suction surface 105*a* of the plunger 105 which makes contact with the inner surface of the first yoke 108 upon driving the plunger 105. The spacer 131*a* extends to a suction surface 105*d*. Second yokes 110 are movably installed in the electromagnetic device 104. Spaces are provided between the second yokes 110 and the engaging portion 107*a* of a bobbin 107.

In the electromagnetic device 104, a pair of permanent magnets 109 is disposed on the inner surface of the first yoke 108. The second yokes 110 make contact with the permanent magnets 109.

In this remote control relay, the second yokes 110 are movable. The gaps between the suction surface 105*d* and the second yokes 110 are decided only by the thickness of the spacer 131*a*. The suction force is kept uniform.

A remote control relay is required to be capable of stabilizing a driving operation with a relatively simple configuration. The configuration of the remote control relay disclosed in Japanese Unexamined Patent Application Publication No. 1993-109525 is not enough to comply with such a requirement and needs to be further improved.

SUMMARY OF THE INVENTION

In view of the above, the present disclosure provides a remote control relay capable of stabilizing a driving operation with a relatively simple configuration.

In accordance with an embodiment of the present invention, there is provided a remote control relay, including: a polarized electromagnet including a coil frame, a coil wound around the coil frame, and a plunger, the polarized electromagnet being configured to, when a current is applied to the coil, move the plunger between a first stop position and a second stop position in a forward and backward movement direction with respect to the coil frame; and an opening/closing mechanism including a contact point unit and configured to open and close the contact point unit in response to a movement of the plunger. The polarized electromagnet further includes: a pair of armatures into which opposite ends of the plunger in the forward and backward movement direction are respectively inserted, the pair of armatures being fixed to the plunger; a yoke to which one of the pair of armatures becomes closer than the other when the plunger is at the first stop position; a permanent magnet whose one magnetic pole makes contact with the yoke; an auxiliary yoke which makes contact with the other magnetic pole of the permanent magnet, the auxiliary yoke becoming closer to the other of the pair of armatures than the one of the pair of armatures when the plunger is at the first stop position; and a gap maintaining portion configured to maintain a gap between the other of the pair of armatures and the auxiliary yoke when the plunger is at the first stop position. When the plunger is at the first stop position, the other of the pair of armatures and the auxiliary yoke comes close to each other with the gap defined by the gap maintaining portion, and a space is provided between the one of the pair of armatures and the yoke.

In the remote control relay, the gap maintaining portion may be a nonmagnetic plate which is provided between the other of the pair of armatures and the auxiliary yoke when the plunger is at the first stop position.

In the remote control relay, the gap maintaining portion may be a protrusion portion which protrudes from the coil frame toward the other of the pair of armatures when the plunger is at the first stop position.

In accordance with the remote control relay of the present embodiment, when the plunger is at the stop position, one of the armatures and the auxiliary yoke become close to each other with the gap defined by the gap maintaining portion. The other armature and the yoke come close to each other with a space therebetween. It is therefore possible to stabilize a driving operation with a relatively simple configuration.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

First Embodiment

Figure 1:
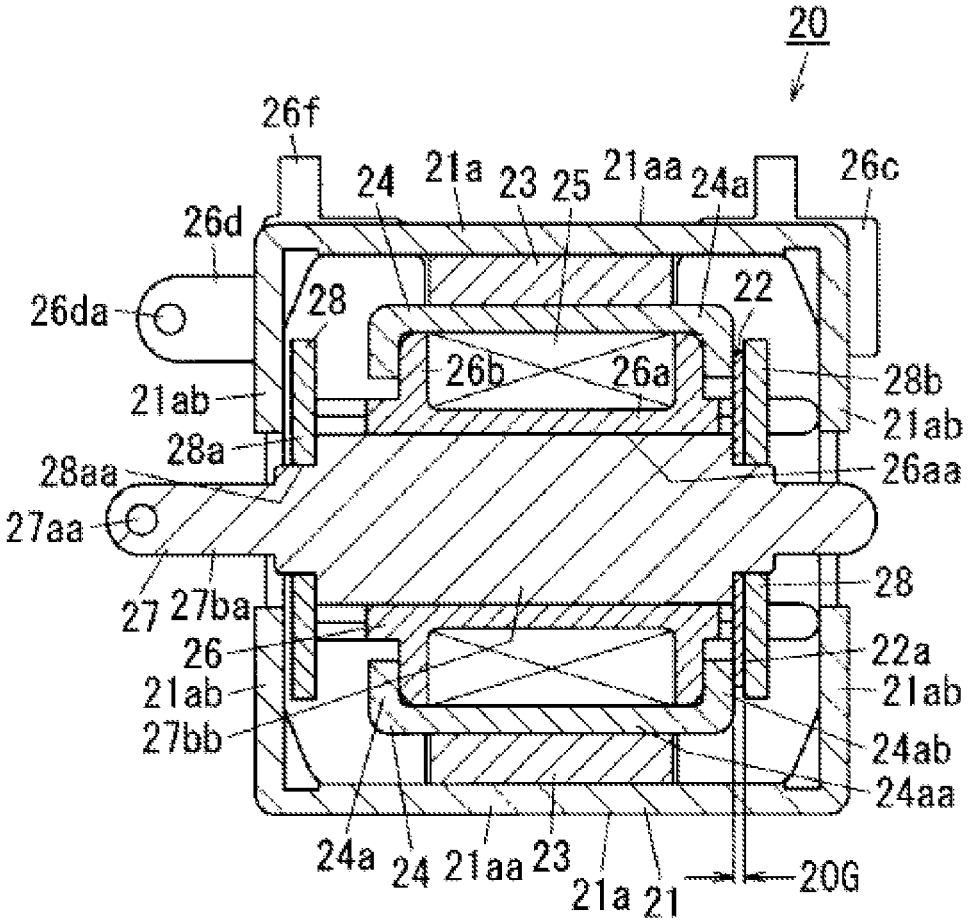
FIG. 1 is a sectional view showing major parts of a remote control relay according to an embodiment.

A remote control relay 10 according to a first embodiment will now be described with reference to FIGS. 1 to 5. Throughout the drawings, identical members are designated by like reference numerals.

Figure 4:
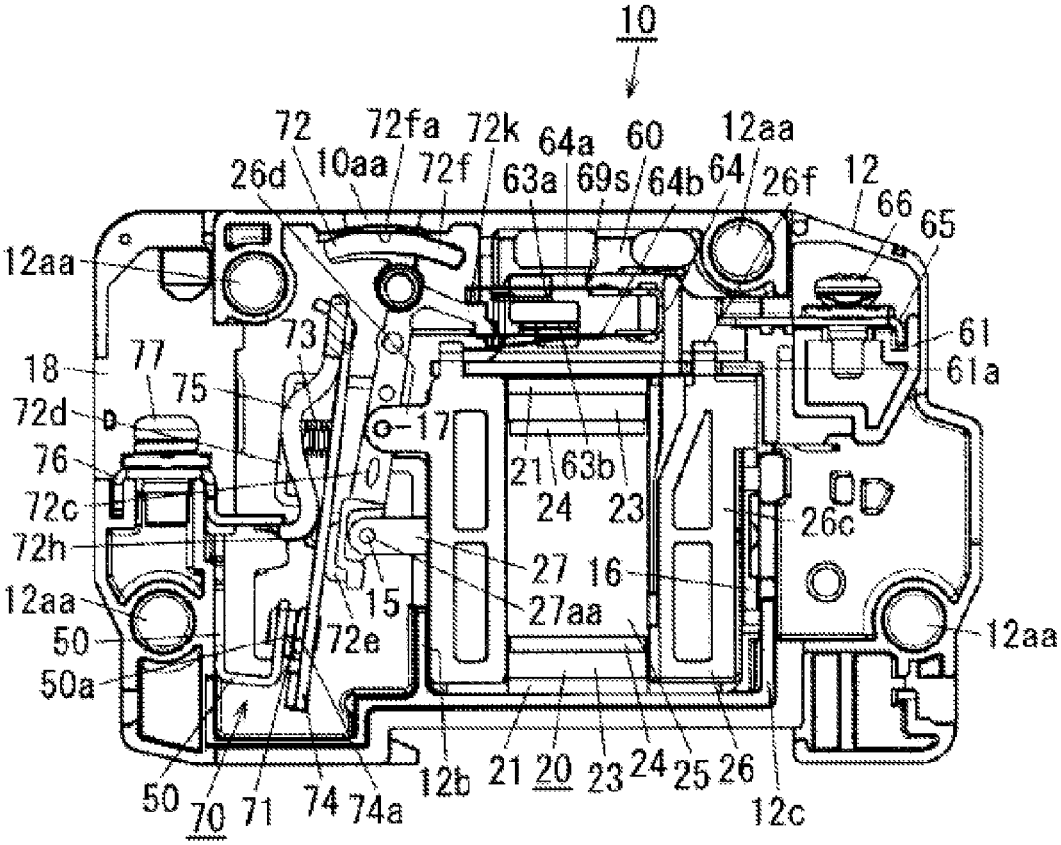
FIG. 4 is a side view showing additional major parts of the remote control relay according to the embodiment.

As shown in FIG. 1, the remote control relay 10 of the present embodiment includes a polarized electromagnet 20 which, when a current is applied to a coil 25, drives a plunger 27 forward and backward with respect to a coil frame 26 around which the coil 25 is wound. Referring to FIG. 4, the remote control relay 10 further includes an opening/closing mechanism 70 which opens and closes a contact point unit 71 as the plunger 27 is moved forward and backward.

The polarized electromagnet 20 includes a pair of armatures 28 installed at the opposite ends of the plunger 27 in the forward/backward movement direction of the plunger 27, and a yoke 21 to which one of the armatures 28 comes closer than the other when the plunger 27 is at a stop position. The polarized electromagnet 20 further includes a pair of permanent magnets 23 each of which makes contact with the yoke 21 at one magnetic pole side thereof, and an auxiliary yoke 24 which makes contact with the other magnetic pole side of each of the permanent magnets 23. The other of the armatures 28, which is more spaced apart from the yoke 21 than the one of the armatures 28, becomes closer to the auxiliary yoke 24 than the one of the armatures 28. The polarized electromagnet 20 further includes a gap maintaining portion 22 which maintains a gap 20G between the other of the armatures 28 and the auxiliary yoke 24.

When the plunger 27 is at the stop position, the other of the armatures 28, which is more spaced apart from the yoke 21, and the auxiliary yoke 24 come close to each other to have the gap 20G defined by the gap maintaining portion 22. In this case, the one of the armatures 28, which is more spaced apart from the auxiliary yoke 24 than the other of the armatures 28, and the yoke 21 come close to each other with a space therebetween.

Thus, the remote control relay 10 of the present embodiment can stabilize a driving operation with a relatively simple configuration.

Hereinafter, the remote control relay 10 of the present embodiment will be described in more detail.

Figure 3:
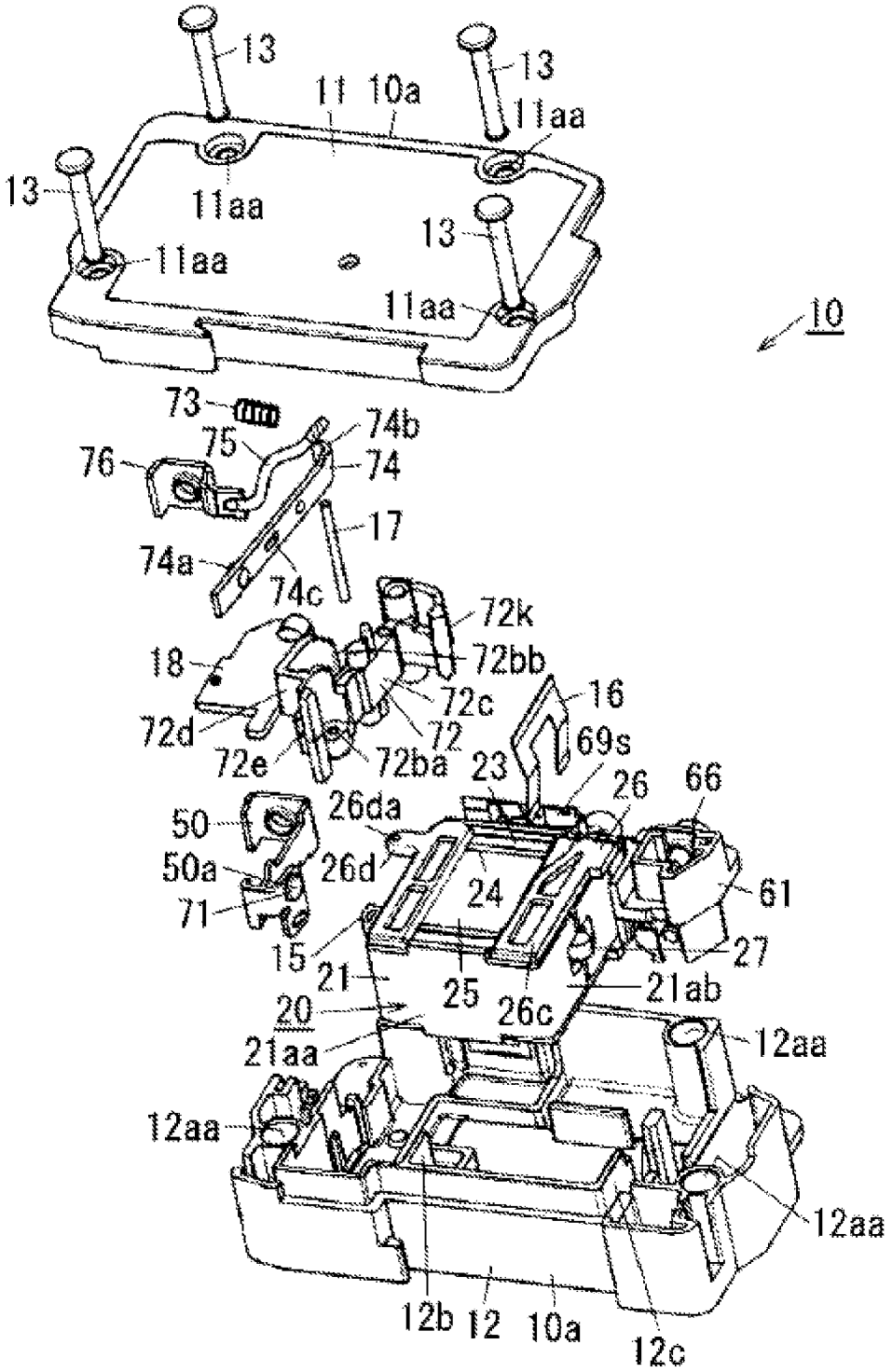
FIG. 3 is an exploded perspective view showing the remote control relay according to the embodiment.

The remote control relay 10 shown in FIG. 3 includes a case 10*a* whose dimension is set equal to the dimension of an agreement-type circuit breaker for an electric light distribution board standardized by JIS (Japanese Industrial Standards). The case 10*a* includes a closed-bottom square-tubular body 12 with one transverse-direction surface thereof opened and a flat plate-shaped cover 11 configured to cover the opening of the body 12. The cover 11 and the body 12 of the case 10*a* may be formed by a molded article of a resin material. As the resin material of the cover 11 and the body 12 of the case 10*a*, it may be possible to use, e.g., a flame-retardant PBT (polybutylene terephthalate) resin. The cover 11 has a plurality of (four, in this example) first through-holes 11*aa* formed in the outer peripheral portion of the cover 11. The body 12 has a plurality of second through-holes 12*aa* formed in the outer peripheral portion of the body 12 in a corresponding relationship with the first through-holes 11*aa*. In the remote control relay 10, caulking pins 13 are inserted into the first through-holes 11*aa* of the cover 11 and the second through-holes 12*aa* of the body 12 so as to protrude outward beyond the bottom surface of the body 12 at the opposite side from the cover 11. In the remote control relay 10, the cover 11 and the body 12 can be coupled by caulking the tips of the caulking pins 13.

In the remote control relay 10, the case 10*a* accommodates the polarized electromagnet 20 which controls the movement of the plunger 27 when a current is applied to the coil 25 and the opening/closing mechanism 70 which opens and closes the contact point unit 71 in response to the forward/backward movement of the plunger 27 (see FIG. 4).

Figure 2:
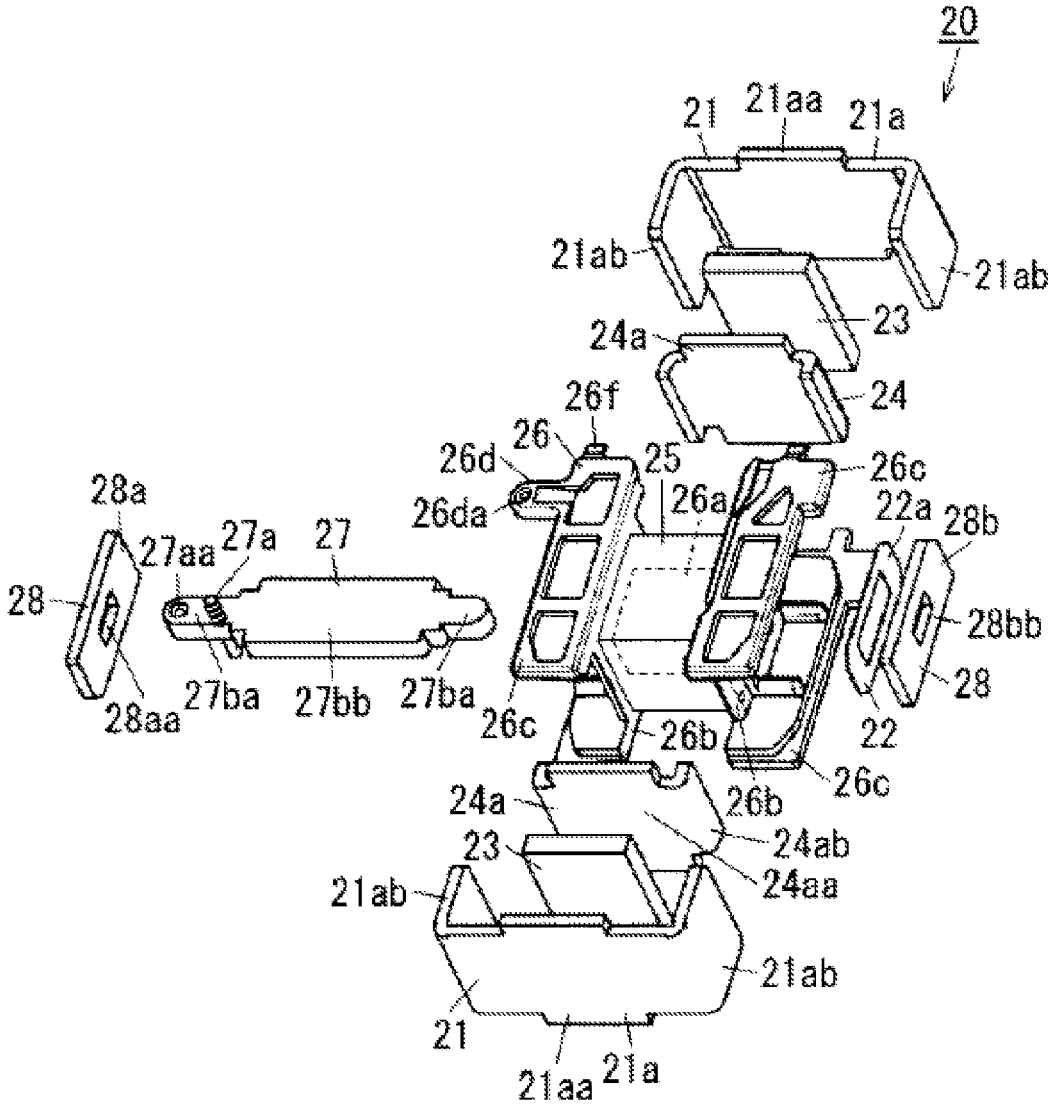
FIG. 2 is an exploded perspective view showing major parts of the remote control relay according to the embodiment.

As shown in FIG. 2, the polarized electromagnet 20 includes, as its major components, the yoke 21, the permanent magnet 23, the auxiliary yoke 24, the coil 25, the coil frame 26, the plunger 27 and the pair of armatures 28.

The yoke 21 is capable of concentrating magnetic field lines to amplify a suction force generated by magnetic force. The yoke 21 may be made of, e.g., a magnetic material such as pure iron, permalloy, silicon steel or the like. In the remote control relay 10 of the present embodiment, the yoke 21 is configured by combining two split yoke portions 21*a*. Each of the split yoke portions 21*a* includes a central piece 21*aa* having a substantially rectangular flat shape and a pair of projection pieces 21*ab* protruding in one direction from the opposite lateral edges of the central piece 21*aa*. Each of the split yoke portions 21*a* is formed to have a substantially C-shaped cross section. In the remote control relay 10 of the present embodiment, the two split yoke portions 21*a* of the yoke 21 are made of the same magnetic material and have the same shape. However, they may be made of different magnetic materials and may have different shapes from each other.

The split yoke portions 21*a* are arranged along the direction orthogonal to the forward/backward movement direction of the plunger 27 (along the up-down direction on the paper sheet surface in FIG. 1). The two split yoke portions 21*a* are disposed such that the tip surfaces of the projection pieces 21*ab* face each other across a specified gap due to the existence of the coil frame 26. That is to say, the two split yoke portions 21*a* are configured such that the yoke 21 as a whole has a square tube shape. In each of the split yoke portions 21*a*, the permanent magnet 23 having a flat shape is installed on the surface of the central piece 21*aa* which serves as the inner bottom surface of each of the C-shaped split yoke portions 21*a*. In each of the split yoke portions 21*a*, the auxiliary yoke 24 is disposed at the other magnetic pole side of the permanent magnet 23 with the permanent magnet 23 interposed between the auxiliary yoke 24 and the split yoke portions 21*a*.

The auxiliary yoke 24 is capable of concentrating magnetic field lines to amplify a suction force generated by magnetic force. The auxiliary yoke 24 is provided to assist the yoke 21. The auxiliary yoke 24 may be made of, e.g., a magnetic material such as pure iron, permalloy, silicon steel or the like. The auxiliary yoke 24 is configured by combining two split auxiliary yoke portions 24*a*. Each of the split auxiliary yoke portions 24*a* includes a central plate 24*aa* having a substantially rectangular flat shape and a pair of projection plates 24*ab* protruding in one direction from the opposite lateral edges of the central plate 24*aa*. Each of the split auxiliary yoke portions 24*a* is formed to have a substantially C-shaped cross section. The split auxiliary yoke portions 24*a* are smaller in size than the split yoke portions 21*a*. The two split auxiliary yoke portions 24*a* of the auxiliary yoke 24 are made of the same magnetic material and have the same shape. However, the two split auxiliary yoke portions 24*a* may be made of different magnetic materials and may have different shapes from each other. The one magnetic pole side of the permanent magnet 23 makes contact with the split yoke portion 21*a* and the other magnetic pole side of the permanent magnet 23 makes contact with the surface of the central plate 24*aa* which serves as the outer bottom surface of each of the C-shaped split auxiliary yoke portions 24*a*. The two split auxiliary yoke portions 24*a* are disposed so as to surround the coil 25 of the coil frame 26.

The coil frame 26 is configured such that the coil 25 can be wound around the coil frame 26. The coil frame 26 may be made of an electrical insulating material such as an epoxy resin, a polyphenylene sulfide resin or the like. The coil frame 26 includes a tubular winding drum portion 26*a* around which the coil 25 is wound and plate-shaped collar portions 26*b* which are provided in the axial opposite end portions of the winding drum portion 26*a*. The coil frame 26 further includes plate-shaped lateral portions 26*c* which protrude from the opposite edges of the collar portion 26*b* toward the opposite direction to the winding drum portion 26*a* along the forward/backward movement direction of the plunger 27. The plunger 27 made of a magnetic material is inserted into an insertion hole 26*aa* of the tubular winding drum portion 26*a* (see FIG. 1). The plunger 27 can move forward and backward in the axial direction of the winding drum portion 26*a*.

The plunger 27 may constitute a movable iron core which can be moved by a magnetic force. The plunger 27 may be made of, e.g., a ferromagnetic material such as iron or the like. The plunger 27 is formed into, e.g., an elongated plate shape, but is not limited thereto and may have a cylindrical shape. In the remote control relay 10 of the present embodiment, opposite end portions 27*ba* of the plunger 27 are smaller in width than a central portion 27*bb* of the plunger 27. The armatures 28 having a rectangular plate shape are installed in the end portions 27*ba* of the plunger 27. In the following description, for the sake of convenience, the armature 28 existing at the left side of the paper sheet surface in FIG. 1 will be referred to as a first armature 28*a* and the armature 28 existing at the right side of the paper sheet surface in FIG. 1 will be referred to as a second armature 28*b*.

One end portion 27*ba* of the plunger 27 is inserted into a first fitting hole 28*aa* of the first armature 28*a*, and the first armature 28*a* is fixed to the one end portion 27*ba* of the plunger 27 by caulking (see FIG. 2). After fixing the first armature 28*a* by caulking, a retaining pin 27*a* may be inserted into the plunger 27 to prevent the first armature 28*a* from slipping from the end portion 27*ba* of the plunger 27. In addition, the other end portion 27*ba* of the plunger 27 is inserted into a second fitting hole 28*bb* of the second armature 28*b* through a nonmagnetic plate 22*a*, and the second armature 28*b* is fixed to other end portion 27*ba* of the plunger 27 by caulking.

In the second armature 28*b*, during the forward/backward movement of the plunger 27, the plate 22*a* makes contact with the projection plate 24*ab* of the auxiliary yoke 24. This makes it possible to restrict the movement range of the plunger 27 in the forward movement direction (the left direction in FIG. 1). It is only necessary that the second armature 28*b* makes contact with one of the projection plates 24*ab* of each of the two split auxiliary yoke portions 24*a* which constitute the auxiliary yoke 24. In the polarized electromagnet 20, at the forward-direction stop position of the plunger 27, a closed magnetic path can be formed by the first armature 28*a*, the yoke 21, the permanent magnet 23, the auxiliary yoke 24, the second armature 28*b* and the plunger 27 in a state in which the first armature 28*a* does not make direct contact with the yoke 21. In the polarized electromagnet 20, the first armature 28*a* and the yoke 21 form the closed magnetic path through a space having a predetermined gap length. In the polarized electromagnet 20, due to the formation of the closed magnetic path, it becomes possible to keep the plunger 27 at the forward-direction stop position.

Furthermore, during the forward/backward movement of the plunger 27, the first armature 28*a* makes contact with the projection plate 24*ab* of the auxiliary yoke 24, thereby restricting the movement range of the plunger 27 in the backward direction (the right direction in FIG. 1). In the polarized electromagnet 20, at the backward-direction stop position of the plunger 27, a closed magnetic path is formed by the second armature 28*b*, the yoke 21, the permanent magnet 23, the auxiliary yoke 24, the first armature 28*a* and the plunger 27. In the polarized electromagnet 20, due to the formation of the closed magnetic path, it becomes possible to keep the plunger 27 at the backward-direction stop position.

When supplied with a current, the coil 25 can generate an electromagnetic force. The coil 25 may be, e.g., a one-winding-type coil. The coil 25 is configured to move the plunger 27 forward or backward depending on the direction of current supply to the coil 25. In the polarized electromagnet 20, if the plunger 27 is moved forward or backward until one of the armatures 28 comes close to the yoke 21, the position of the plunger 27 can be maintained by the magnetic force of the permanent magnet 23 even when the supply of a current to the coil 25 is stopped.

In the remote control relay 10 of the present embodiment, as shown in FIGS. 3 and 4, the polarized electromagnet 20 is disposed between a first partition piece 12*b* and a second partition piece 12*c* which are provided to protrude from the surface of the body 12 facing toward the cover 11. In the remote control relay 10, it is preferred that a leaf spring 16 having a substantially C-shaped contour is inserted between the polarized electromagnet 20 and the second partition piece 12*c*. In the remote control relay 10, the polarized electromagnet 20 can be accommodated within the body 12 in such a state that the polarized electromagnet 20 is pressed against the first partition piece 12*b* by the leaf spring 16. In the remote control relay 10, it is possible for the leaf spring 16 to reduce the vibration generated by the forward/backward movement of the plunger 27.

Next, description will be made on the opening/closing mechanism 70 of the remote control relay 10 according to the present embodiment.

The opening/closing mechanism 70 may be configured to mainly include, e.g., a contact point unit 71, an interlocking lever 72 which swings in response to the forward/backward movement of the plunger 27 of the polarized electromagnet 20, and a contact pressure spring 73 which applies a contact pressure to the contact point unit 71 (see FIG. 4).

The contact point unit 71 can open and close an electric path connected to the remote control relay 10. The remote control relay 10 of the present embodiment includes a single-pole contact point unit 71. The contact point unit 71 includes a movable contact point 74*a* and a fixed contact point 50*a*. The contact point unit 71 may be configured to include a movable contactor 74 having a movable contact point 74*a* and a fixed terminal plate 50 having a fixed contact point 50*a*. The movable contactor 74 can be moved to make contact with the fixed contact point 50*a*. The movable contactor 74 may be formed of an elongated metal plate. The movable contactor 74 may be made of a metallic material having high electric conductivity, such as copper, copper-tungsten alloy or the like. In the fixed terminal plate 50, the fixed contact point 50*a* is provided to face the movable contact point 74*a*. The fixed terminal plate 50 may be formed into an S-like shape by a metal plate. The fixed terminal plate 50 may be made of a metallic material having high electric conductivity, such as copper, copper-tungsten alloy or the like. The movable contactor 74 and the fixed terminal plate 50 may be made of the same material or may be made of different materials. A silver film may be formed on the surfaces of the movable contactor 74 and the fixed terminal plate 50 by a plating process or other processes. In the contact point unit 71 of the remote control relay 10 of the present embodiment, the fixed contact point 50*a* and the movable contact point 74*a* make contact with each other or move away from each other in response to the forward/backward movement of the plunger 27.

The interlocking lever 72 is preferably installed to switch the opening and closing of the contact point unit 71 in response to the forward/backward movement of the plunger 27. The interlocking lever 72 may be formed into an elongated plate shape by a synthetic resin molded article having an electric insulating property. In the interlocking lever 72, a first shaft pin 15 installed in a through-hole portion 27*aa* of one end portion 27*ba* of the plunger 27 is inserted into a first shaft hole 72*ba* (see FIGS. 3 and 4). The interlocking lever 72 is rotatably connected to the plunger 27 by virtue of the first shaft pin 15 and the first shaft hole 72*ba*. In the interlocking lever 72, a second shaft pin 17 passes through insertion hole portions 26*da* of a pair of support pieces 26*d* of the coil frame 26 and further passes through a second shaft hole 72*bb* formed in an intermediate portion of a body portion 72*c*. The interlocking lever 72 is rotatably supported on the coil frame 26 by the second shaft pin 17. The first shaft pin 15 and the second shaft pin 17 are disposed such that the axis of the first shaft pin 15 and the axis of the second shaft pin 17 become parallel to each other. Thus, upon moving the plunger 27 forward and backward, the interlocking lever 72 can swing about the second shaft pin 17. The interlocking lever 72 holds the movable contactor 74 at the opposite side of the body portion 72*c* from the polarized electromagnet 20.

The movable contactor 74 swings together with the interlocking lever 72. The movable contactor 74 includes the movable contact point 74*a* at one longitudinal end thereof (at the lower end thereof in FIG. 4). One end portion of a flexible electric wire 75 composed of a braided copper wire is electrically connected to the other longitudinal end (the upper end in FIG. 4) of the movable contactor 74.

The other end of the flexible electric wire 75, which is opposite to the one end connected to the movable contactor 74, is electrically connected to a terminal piece 76 fixed to the case 10*a*. The terminal piece 76 is attached to the body 12 by a first terminal screw 77 having a washer. In the remote control relay 10, the first terminal screw 77 is exposed to the outside of the case 10*a*. Preferably, the flexible electric wire 75 is disposed between the interlocking lever 72 and the movable contactor 74 and the case 10*a* so as not to hinder the swing operations of the interlocking lever 72 and the movable contactor 74.

The interlocking lever 72 includes a spring rest portion 72*d* which is integrally formed with the body portion 72*c* of the interlocking lever 72. The spring rest portion 72*d* has a C-like shape when seen in a side view and has a contour with an open surface facing toward the movable contactor 74. The spring rest portion 72*d* holds one end of the contact pressure spring 73 formed of a coil spring. The other end of the contact pressure spring 73 makes contact with the movable contactor 74 which is inserted between the body portion 72*c* and the spring rest portion 72*d*. Preferably, the movable contactor 74 includes, at the longitudinal intermediate portion thereof, a protrusion portion (not shown) which serves as a spring seat of the contact pressure spring 73. The movable contactor 74 further includes, below the protrusion portion serving as the spring seat, a through-hole 74*c* into which a positioning lug 72*h* of the interlocking lever 72 is inserted (see FIGS. 3 and 4). In addition, the interlocking lever 72 is provided with a fulcrum protrusion 72*e* which has a curved surface and which can make contact with the movable contactor 74.

The interlocking lever 72 includes, in the upper end portion thereof, an indication piece 72*f* which faces toward a window portion 10*aa* opened in the case 10*a*. In the remote control relay 10, if the interlocking lever 72 is swung in response to the forward/backward movement of the plunger 27, the exposed indication surface of the indication piece 72*f* exposed through the window portion 10*aa* is changed. For example, when the contact point unit 71 is in a closed state, the remote control relay 10 allows a user to visually recognize, through the window portion 10*aa*, the indication surface of the indication piece 72*f* on which characters such as "ON" or the like are marked. Similarly, for example, when the contact point unit 71 is in an open state, the remote control relay 10 allows a user to visually recognize, through the window portion 10*aa*, the indication surface of the indication piece 72*f* on which characters such as "OFF" or the like are marked. In the interlocking lever 72, a groove portion 72*fa* is provided in the indication piece 72*f* which is exposed through the window portion 10*aa* at all times. In the remote control relay 10, for example, a user may insert a sharp tool, such as the tip of a flat-blade screwdriver or the like, into the window portion 10*aa* and may fit the sharp tool to the groove portion 76*fa*, whereby the user can swing the interlocking lever 72 through a manual operation performed outside the case 10*a*. Accordingly, the remote control relay 10 is configured so that the contact point unit 71 can be opened and closed by manually operating the interlocking lever 72.

The fixed terminal plate 50 is attached to the body 12 such that one end portion thereof, which is opposite to the other end portion to which the fixed contact point 50*a* is fixed, is exposed to the outside of the case 10*a*. The fixed terminal plate 50 is configured such that the one end portion thereof exposed from the case 10*a* can be attached to the body 12 using a terminal screw (not shown) having a washer. In the remote control relay 10 of the present embodiment, the fixed terminal plate 50 and the terminal piece 76 electrically connected to the movable contactor 74 are accommodated within the case 10*a* in the transverse direction. In the remote control relay 10, a partition wall 18 is disposed between the terminal piece 76 and the fixed terminal plate 50. The partition wall 18 may be made of a synthetic resin having an electric insulating property. In the remote control relay 10, the electric insulation between the fixed terminal plate 50 and the terminal piece 76 can be assured by the partition wall 18 fixed to the body 12.

In the remote control relay 10 of the present embodiment, the coil 25 is of the one winding type. In order to move the plunger 27 forward and backward, it is necessary to reverse the direction of current supply to the coil 25.

The remote control relay 10 includes a switching contact point 69*s* which switches the current supply direction to move the plunger 27 forward or backward. In the switching contact point 69*s*, the current supply direction is selected so as to move the plunger 27 toward the opposite direction to the present stop position of the plunger 27. In the remote control relay 10, the interlocking lever 72 is provided with a contact point operating piece 72*k*, thereby interlocking the forward/backward movement of the plunger 27 and the opening/closing of the switching contact point 69*s*.

Figure 5:
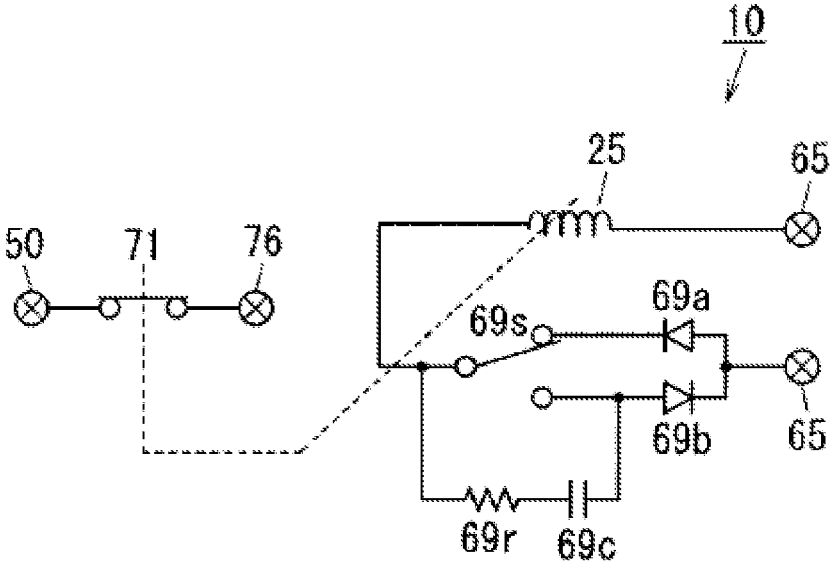
FIG. 5 is an internal circuit diagram of the remote control relay according to the embodiment.

In the remote control relay 10, as shown in FIG. 5, the switching contact point 69*s* may be configured so that one of two current supply routes leading to the coil 25 can be selected. In the remote control relay 10, a first diode 69*a* is connected to one of the current supply routes, and a second diode 69*b* is connected to the other one of the current supply routes. The first diode 69*a* and the second diode 69*b* are electrically connected in such a way that currents flow through the respective current supply routes in the mutually opposite directions. The first diode 69*a* and the second diode 69*b* serve as backflow inhibiting elements which inhibit a current from flowing backward through the current supply route selected by the switching contact point 69*s*. Opposite ends of the first diode 69*a* and the second diode 69*b* from the switching contact point 69*s* are connected to each other. In the remote control relay 10, a series circuit of a capacitor 69*c* and a resistor 69*r* is connected between the second diode 69*b* and the switching contact point 69*s*. In the remote control relay 10, if a current is supplied to the coil 25 through a pair of coil terminal plates 65 in response to an inputted external signal, the plunger 27 is moved forward or backward depending on the current supply direction. The contact point unit 71 can be opened or closed in response to the forward/backward movement of the plunger 27.

The switching contact point 69*s* constitutes a switching block unit 60, together with a contact point substrate (not shown) which forms a switching circuit of the switching contact point 69*s* (see FIG. 4). In the remote control relay 10 of the present embodiment, a resin-molded base 61 mounted to the polarized electromagnet 20 holds the switching block unit 60. As shown in FIG. 4, the switching block unit 60 includes a first fixed contact point plate 63*a* and a second fixed contact point plate 63*b*. The switching block unit 60 further includes a first movable contact point plate 64*a* installed at a position facing the first fixed contact point plate 63*a*. In addition, the switching block unit 60 includes a second movable contact point plate 64*b* installed at a position facing the second fixed contact point plate 63*b*.

A cutout 61*a* is provided in the peripheral portion of the base 61 for holding the switching block unit 60. A first rib 26*f* protruding upward from the coil frame 26 engages with the cutout 61*a*. The base 61 is fixed to the coil frame 26 by a thermal bonding in a state in which the first rib 26*f* has engaged with the cutout 61*a*. The first movable contact point plate 64*a* is installed at one leg piece of a contact point support plate 64 having a C-like shape when seen in a side view. The first movable contact point plate 64*a* has a spring force acting in such a direction that the first movable contact point plate 64*a* makes contact with the first fixed contact point plate 63*a* corresponding thereto. Similarly, the second movable contact point plate 64*b* is installed at the other leg piece of the C-shaped contact point support plate 64. The second movable contact point plate 64*b* has a spring force acting in such a direction that the second movable contact point plate 64*b* makes contact with the second fixed contact point plate 63*b* corresponding thereto. The contact point operating piece 72*k* of the interlocking lever 72 is inserted between the first movable contact point plate 64*a* and the second movable contact point plate 64*b*.

In the remote control relay 10, when the interlocking lever 72 is swung in response to the forward/backward movement of the plunger 27, the second movable contact point plate 64*b* is pressed against the contact point operating piece 72*k* at the forward-direction stop position of the plunger 27. The second movable contact point plate 64*b* is moved away from the second fixed contact point plate 63*b* by the contact point operating piece 72*k*, whereby the current supply direction is switched. Similarly, in the remote control relay 10, the first movable contact point plate 64*a* is pressed against the contact point operating piece 72*k* at the backward-direction stop position of the plunger 27. The first movable contact point plate 64*a* is moved away from the first fixed contact point plate 63*a* by the contact point operating piece 72*k*, whereby the current supply direction is switched.

A pair of coil terminal plates 65 is attached to the base 61. A second terminal screw 66 having a washer is provided in each of the coil terminal plates 65.

Next, description will be made on the operation of the remote control relay 10 according to the present embodiment.

In the remote control relay 10, if a current is applied to the coil 25 such that the plunger 27 moves forward (leftward in FIG. 4), the interlocking lever 72 is rotated clockwise in FIG. 4 about the second shaft pin 17 in response to the forward movement of the plunger 27. The movable contact point 74*a* and the fixed contact point 50*a* make contact with each other by the rotation of the interlocking lever 72. The movable contactor 74 is kept in contact with the fulcrum protrusion 72*e*. A force for rotating the movable contactor 74 clockwise about the fulcrum protrusion 72*e* is applied to the movable contactor 74 by the contact pressure spring 73. For that reason, in the movable contactor 74, the contact pressure of the movable contact point 74*a* applied to the fixed contact point 50*a* can be adjusted by the contact pressure spring 73. As the interlocking lever 72 rotates clockwise, the second movable contact point plate 64*b* is pressed against the contact point operating piece 72*k* and is spaced apart from the second fixed contact point plate 63*b*. In this case, a current is permitted to flow through the coil 25 only in the direction in which the plunger 27 is moved backward. Therefore, the current supply to the coil 25 is stopped. However, the contact point unit 71 is kept in a closed state by the magnetic forces of two permanent magnets 23.

In the remote control relay 10, if a current flows through the coil 25 in a reversed direction, the plunger 27 moves backward (rightward in FIG. 4). The interlocking lever 72 rotates counterclockwise in FIG. 4 about the second shaft pin 17. The movable contact point 74*a* is moved away from the fixed contact point 50*a*, whereby the contact point unit 71 comes into an open state. As the interlocking lever 72 rotates counterclockwise, the first movable contact point plate 64*a* is pressed against the contact point operating piece 72*k*. Thus, the first movable contact point plate 64*a* is spaced apart from the first fixed contact point plate 63*a*. In this case, a current is permitted to flow through the coil 25 only in the direction in which the plunger 27 is moved forward. Therefore, the current supply to the coil 25 is stopped. However, the contact point unit 71 is kept in an open state by the magnetic forces of two permanent magnets 23.

In the remote control relay 10, the electromagnetic force of the polarized electromagnet 20 tends to sharply increase as the yoke 21 and the armature 28 come close to each other. In a comparative remote control relay (not shown), which will be compared with the present embodiment, it is considered to arrange, between the yoke 21 and the armatures 28, a plate for adjusting the gap between the yoke 21 and the armatures 28 in order to suppress a sharp increase in the electromagnetic force of the polarized electromagnet 20. In this comparative remote control relay, the stop position of the plunger 27 is adjusted by the plate for adjusting the gap between the yoke 21 and the armatures 28, thereby suppressing a sharp increase in the suction force acting on the plunger 27 and the armatures 28.

However, in the comparative remote control relay, for example, if variations exist in the dimensional accuracy of the metallic components such as the yoke 21 and the like which constitute the polarized electromagnet 20, there is a possibility that the fluctuation of the suction force is generated despite the arrangement of the plate for adjusting the gap between the yoke 21 and the armatures 28. In the comparative remote control relay, if the fluctuation of the suction force acting on the plunger 27 is generated, there is a fear that the driving operation of the plunger 27 becomes unstable and malfunction occurs. For that reason, in the comparative remote control relay, if the driving operation of the plunger 27 is unstable, it may be necessary to adjust the contact point pressure of the contact point unit 71 by the replacement of the contact pressure spring 73 or the like.

The present inventors have found the fact that the variation in the gap between the auxiliary yoke 24 and the armature 28 more heavily affects the fluctuation of the suction force acting on the plunger 27 than does the variation in the gap between the yoke 21 and the armatures 28.

In the remote control relay 10 of the present embodiment, the gap 20G between the auxiliary yoke 24 and the armatures 28 is maintained at a predetermined value by the gap maintaining portion 22. In the remote control relay 10, the gap between the armature 28 and the yoke 21 is indirectly defined by the gap maintaining portion 22. Thus, the remote control relay 10 of the present embodiment is capable of stabilizing the driving operation with a relatively simple configuration.

In the remote control relay 10 of the present embodiment, the first armature 28*a* faces the yoke 21 through a space at the stop position of the plunger 27. The nonmagnetic plate 22*a* disposed between the second armature 28*b* and the auxiliary yoke 24 is provided as the gap maintaining portion 22 which maintains the gap 20G between the second armature 28*b* and the auxiliary yoke 24. In other words, the gap maintaining portion 22 is the nonmagnetic plate 22*a* installed between the armature 28, that is more spaced apart from the yoke 21 when the plunger 27 is at the stop position, and the auxiliary yoke 24.

The nonmagnetic plate 22*a* may be made of a metallic material such as stainless, aluminum alloy or the like, a resin material, or a semiconductor material such as silicon or the like. The use of the nonmagnetic plate 22*a* makes it possible to suppress the leakage of magnetic field lines or the loss of a magnetic force which may occur due to unnecessary heat generation. It is only necessary that the plate 22*a* can maintain the gap 20G between the armature 28 and the auxiliary yoke 24 at a predetermined value. The plate 22*a* may be formed into various kinds of shapes. In the remote control relay 10 of the present embodiment, the plate 22*a* is provided only between the second armature 28*b* and the auxiliary yoke 24. Alternatively, the plate 22*a* may be provided between the second armature 28*b* and the auxiliary yoke 24 and also between the first armature 28*a* and the auxiliary yoke 24.

Figure 6:
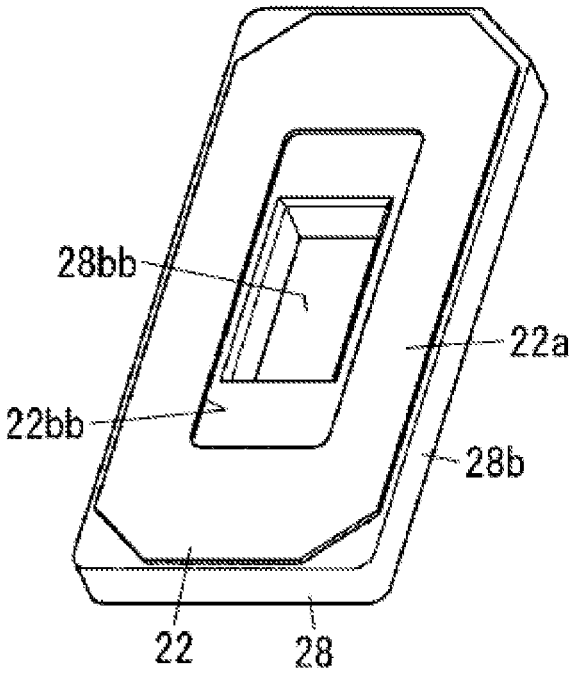
FIG. 6 is a perspective view showing other major parts of the remote control relay according to the embodiment.

As shown in FIG. 6, it is preferable that the second armature 28*b* and the plate 22*a* are fixed to each other in one body. If both the second armature 28*b* and the plate 22*a* are made of a metallic material, it becomes easy to fix the second armature 28*b* and the plate 22*a* by, e.g., welding. The plate 22*a* has a hole 22*bb* larger in size than the second fitting hole 28*bb* of the second armature 28*b*. In the remote control relay 10 of the present embodiment, by fixing the nonmagnetic plate 22*a* to the second armature 28*b*, it is possible to suppress occurrence of biting of the plate 22*a* which may be caused due to the bounce with the second armature 28*b*. Moreover, in the remote control relay 10, it is possible to suppress occurrence of a fluctuation in the gap 20G, thereby increasing the reliability.

Next, a remote control system 90 employing the remote control relay 10 according to the present embodiment will be described with reference to FIG. 7.

Figure 7:
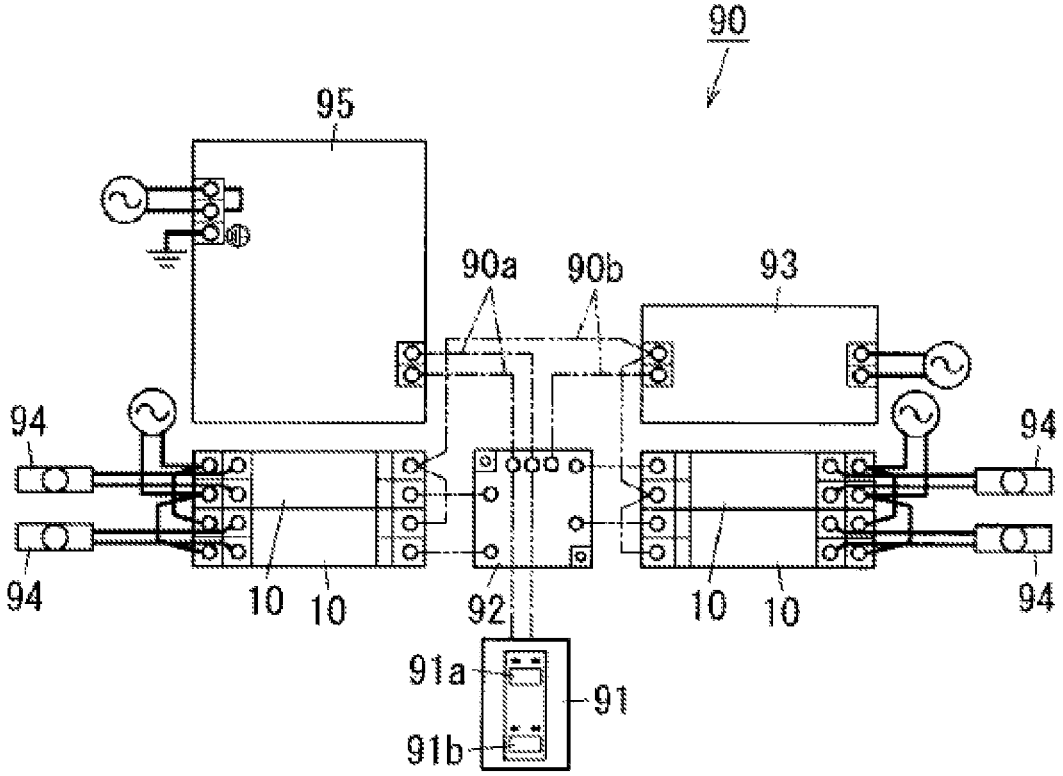
FIG. 7 is a schematic configuration diagram of a remote control system which makes use of the remote control relay according to the embodiment.

In the remote control system 90 shown in FIG. 7, an operation terminal 91, a control terminal 92 and a transmission unit 95 are electrically connected to one another via two-wire-type transmission lines 90*a* indicated by single-dot chain lines. The control terminal 92 controls the current supply to loads 94 such as luminaire through the use of the remote control relays 10. A power transformer 93 supplies a current to a plurality of (four, in this example) remote control relays 10 and the control terminal 92 via power lines 90*b* indicated by double-dot chain lines. In the remote control system 90 shown in FIG. 7, only one operation terminal 91 and only one control terminal 92 are shown, but the number of the operation terminal 91 and the control terminal 92 may be appropriately changed.

In the remote control system 90, by transmitting a transmission signal from the transmission unit 95, data can be transmitted and received between the operation terminal 91 and the control terminal 92. The transmission signal may contain a start pule, mode data, address data, control data, an error correction code and a return standby period. The mode data indicates, e.g., a mode of the signal. The control data indicates control contents such as turning-on, turning-off or dimming of the loads 94. The return standby period indicates a period for returning a return signal from the operation terminal 91 and the control terminal 92. As the transmission signal, it may be possible to use, e.g., a time-division multiplexed signal of multi-polarities (±24 V). The remote control system 90 can transmit data by pulse-width-modulation of the transmission signal.

The operation terminal 91 and the control terminal 92 accept the control data of the transmission signal received via the transmission lines 90*a* if the address contained in the address data of the transmission signal coincide with the predetermined address of the operation terminal 91 and the control terminal 92. When the operation terminal 91 and the control terminal 92 receive the transmission signal having their own address, they return a return signal as a current mode signal, in synchronization with the return standby period of the transmission signal. The current mode signal may be a signal which is transmitted by short-circuiting the transmission lines 90*a* through a suitable electronic part having low impedance. If a first operation switch 91*a* or a second operation switch 91*b* of the operation terminal 91 is operated, the operation terminal 91 transmits an interrupt signal in a current mode in synchronization with the start pulse of the transmission signal transmitted during a normal time.

The transmission unit 95 executes a signal transmission process and an interrupt process. By executing the signal transmission process, the transmission unit 95 constantly transmits a transmission signal containing an address data of the operation terminal 91, which is constantly monitored, or an address data of a dummy, with the mode data set to a polling mode. Upon receiving an interrupt signal in a polling mode, the transmission unit 95 sequentially transmits transmission signals containing a group address by virtue of executing the interrupt process, and detects the operation terminal 91 which has transmitted the interrupt signal. The term "group address" refers to an address used in identifying the operation terminal 91 on a group-by-group basis.

When the group address to which the operation terminal 91 that has transmitted the interrupt signal belongs is accessed, the operation terminal 91 which has transmitted the interrupt signal returns its own address as a return signal during the return standby period. The transmission unit 95, which has received the address data as the return signal, identifies the operation terminal 91 which has generated the interrupt signal, based on the address data. If the interrupted operation terminal 91 is identified, the transmission unit 95 transmits a transmission signal to access to the operation terminal 91 and allows the operation terminal 91 to return an operation data of the first operation switch 91*a* as a monitoring data during the return standby period.

Upon receiving the monitoring data through a series of interrupt processes, the transmission unit 95 prepares a control data of the control terminal 92 previously associated with the operation terminal 91. The transmission unit 95 transmits a transmission signal containing the control data and the address data of the control terminal 92 by way of time-division multiplex transmission. The control terminal 92 accessed by the transmission signal controls the remote control relay 10 in accordance with the control content of the control data and controls the on/off operation of the power supply to the loads 94. That is to say, in the remote control system 90, in response to the operation of the first operation switch 91*a* of the operation terminal 91, the on/off operation of the power supply to the loads 94 can be controlled by the corresponding control terminal 92 through the remote control relay 10.

Second Embodiment

Figure 8:
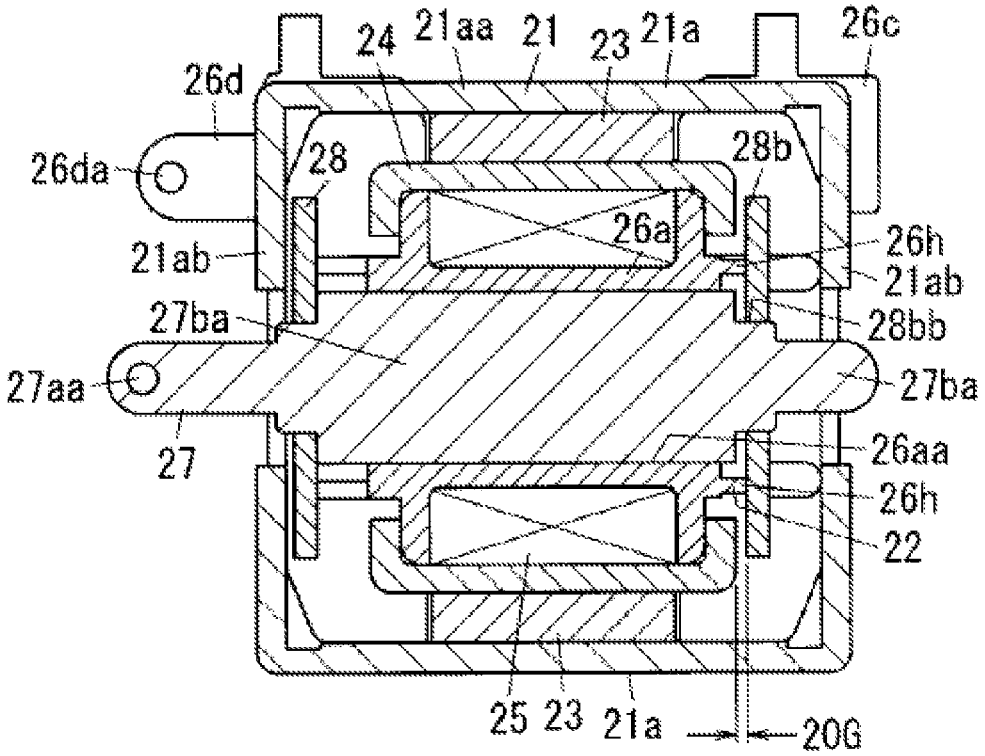
FIG. 8 is a sectional view showing major parts of a remote control relay according to another embodiment.

A remote control relay 10 of a second embodiment mainly differs from the remote control relay 10 of the first embodiment in that, instead of the plate 22*a* shown in FIG. 1, a protrusion portion 26*h* shown in FIG. 8 is used as the gap maintaining portion 22. The same components as those of the first embodiment will be designated by like reference symbols and will not be described.

Figure 9:
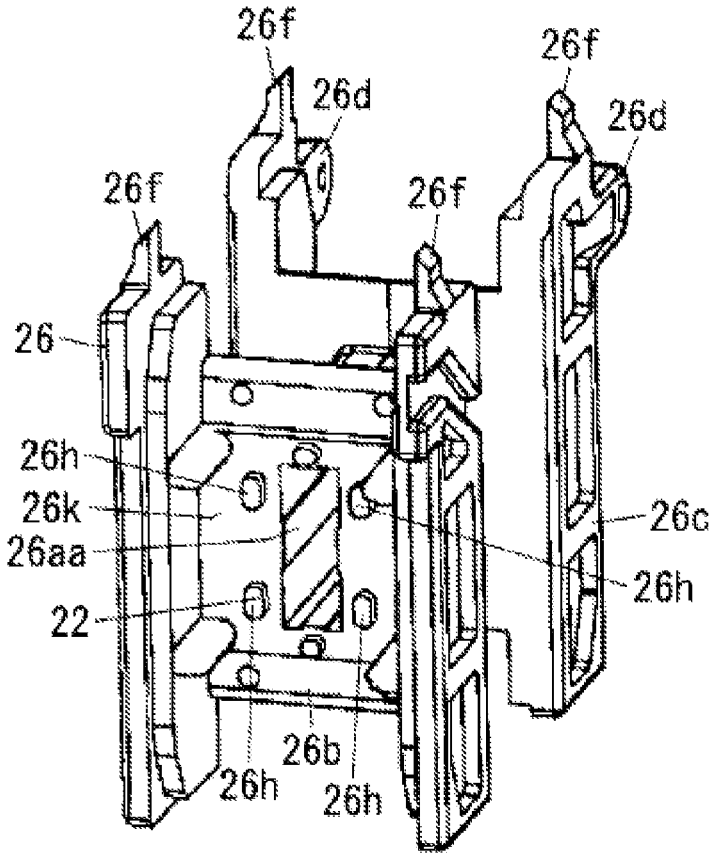
FIG. 9 is a perspective view showing additional major parts of the remote control relay according to the another embodiment.

In the remote control relay 10 of the second embodiment, as shown in FIGS. 8 and 9, the gap maintaining portion 22 is a protrusion portion 26*h* which protrudes from the coil frame 26 toward the armature 28, that is more spaced apart from the yoke 21, at the stop position of the plunger 27.

The remote control relay 10 of the second embodiment can maintain the gap 20G between the auxiliary yoke 24 and the armature 28 at a predetermined value using the protrusion portion 26*h* of the coil frame 26. If the coil frame 26 is formed of a resin molded article, it becomes possible to accurately manage the gap 20G. Since the remote control relay 10 of the second embodiment does not include the plate 22*a* employed in the first embodiment, the configuration of the remote control relay 10 of the second embodiment can be more simplified.

In the remote control relay 10 of the second embodiment, a plurality of (four, in this example) protrusion portions 26*h* is disposed in the periphery of the insertion hole 26*aa* of the coil frame 26. The protrusion portions 26*h* is provided to maintain the predetermined gap 20G between the armature 28 and the auxiliary yoke 24 by making contact with the armature 28. The gap 20G may be appropriately set depending on the configuration of the polarized electromagnet 20 or the electric power supplied to the coil 25. At least one protrusion portion 26*h* may be provided in order to form the predetermined gap 20G between the armature 28 and the auxiliary yoke 24. In the remote control relay 10, if three or more protrusion portions 26*h* make contact with the armature 28, it becomes relatively easy to stably secure the gap 20G. The protrusion portions 26*h* may be formed into a cylindrical shape, a polygonal columnar shape, a truncated conical shape or a truncated pyramidal shape. Each of the protrusion portions 26*h* may have a smooth surface or a surface with a plurality of irregularities.

In the remote control relay 10, if the protrusion portions 26*h* are one-piece formed with the coil frame 26, it becomes easy to increase the dimensional accuracy of the gap maintaining portion 22. However, the protrusion portions 26*h* do not have to be necessarily one-piece formed with the coil frame 26. In the remote control relay 10, the protrusion portions 26*h* and the coil frame 26 may be formed independently from each other, and the protrusion portions 26*h* may be fixed to the coil frame 26. If the protrusion portions 26*h* and the coil frame 26 are formed independently from each other, the mechanical strength of the protrusion portions 26*h* that make contact with the armature 28 may be set higher than the mechanical strength of the coil frame 26. The protrusion portions 26*h* may be made of a metallic material or a semiconductor material, which differs from the material of the coil frame 26. As the metallic material, stainless steel which is nonmagnetic material may be used. As the semiconductor material, silicon may be used. If the protrusion portions 26*h* are made of the semiconductor material, it becomes possible to more accurately form the gap 20G with a precise dimension.

It is only necessary that the remote control relay 10 of the second embodiment includes the protrusion portions 26*h* which make contact with the armature 28. The configuration of the remote control relay 10 of the second embodiment is not limited to the configuration including the coil frame 26 shown in FIG. 9. The remote control relay 10 of the second embodiment may be configured by appropriately combining the configuration of the first embodiment. For example, the plate 22*a* described in the first embodiment may be provided at the side of the first armature 28*a*, and the protrusion portions 26*h* may be provided at the side of the second armature 28*b*.

Third Embodiment

Figure 10:
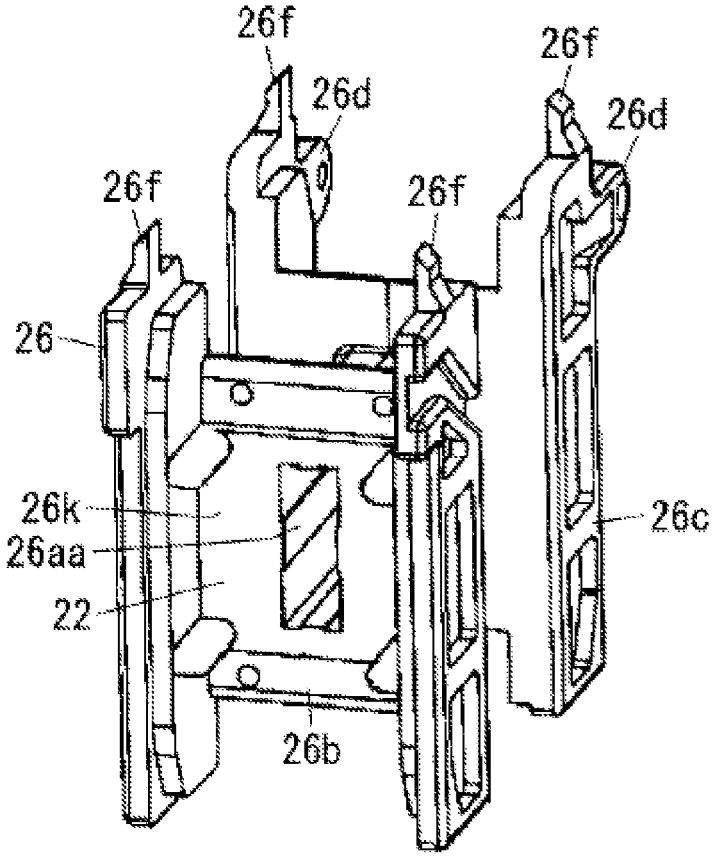
FIG. 10 is a perspective view showing major parts of a remote control relay according to a still another embodiment.
Figure 11:
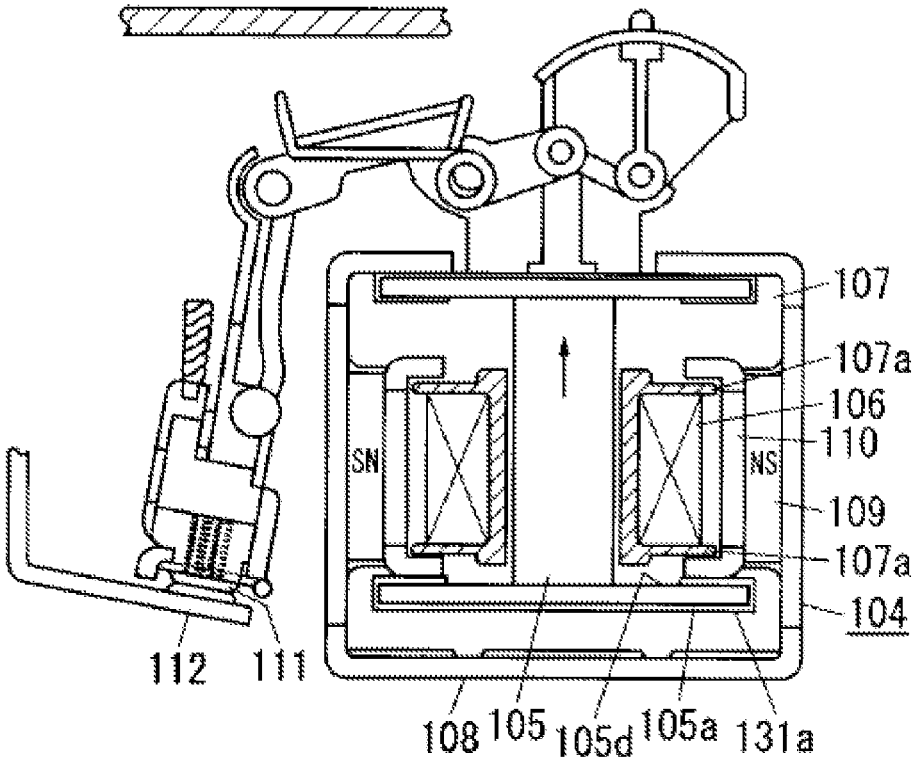
FIG. 11 is a side view showing a conventional contact point unit and a conventional electromagnetic device.

A remote control relay 10 of a third embodiment mainly differs from the remote control relay 10 of the second embodiment in that, instead of the protrusion portions 26*h* shown in FIG. 9, a surface 26*k* existing in the periphery of the insertion hole 26*aa* of the coil frame 26 shown in FIG. 10 is allowed to make contact with the armature 28 and is used as the gap maintaining portion 22. The same components as those of the second embodiment will be designated by like reference symbols and will not be described.

In the remote control relay 10 of the third embodiment, when the plunger 27 is at the stop position, the surface 26*k* of the coil frame 26 makes contact with the armature 28 that is more spaced apart from the yoke 21.

In the remote control relay 10 of the third embodiment, the gap between the auxiliary yoke 24 and the armature 28 can be kept at a predetermined gap 20G using the surface 26*k* of the coil frame 26. Further, the remote control relay 10 of the third embodiment can be further simplified in configuration, due to the omission of the nonmagnetic plate 22*a*. Moreover, in the remote control relay 10, if the coil frame 26 is formed of a resin molded article, it becomes possible to accurately manage the gap 20G.

In the remote control relay 10 of the third embodiment, it is only necessary that the surface 26*k* of the coil frame 26 can make contact with the armature 28 to form the predetermined gap 20G between the armature 28 and the auxiliary yoke 24. It is not necessarily required to form the surface 26*k* of the coil frame 26 into a smooth surface. The surface 26*k* of the coil frame 26 may be formed into different kinds of shapes such a concave curved surface or a slant surface in conformity with the shape of the armature 28 opposite thereto. In the remote control relay 10, the coil frame 26 may be provided with an additional specified member (not shown), and the surface of the specified member may be used as the surface 26*k* of the coil frame 26.

In the remote control relay 10 of the third embodiment, it is only necessary that the surface 26*k* of the coil frame 26 can make contact with the armature 28 to maintain the predetermined gap 20G. The configuration of the remote control relay 10 of the third embodiment is not limited to the configuration including the coil frame 26 shown in FIG. 10. The remote control relay 10 of the third embodiment may be configured by appropriately combining the plate 22*a* described in the first embodiment or the protrusion portions 26*h* described in the second embodiment.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein.

It is intended by the following claims to claim any and all modifications and variations that fall within the true scope of the present teachings.

What is claimed is:

1. A remote control relay, comprising:

a polarized electromagnet including a coil frame, a coil wound around the coil frame, and a plunger, the polarized electromagnet being configured to, when a current is applied to the coil, move the plunger between a first stop position and a second stop position in a forward and backward movement direction with respect to the coil frame; and an opening/closing mechanism including a contact point unit and configured to open and close the contact point unit in response to a movement of the plunger, wherein the polarized electromagnet further includes:

a pair of armatures into which opposite ends of the plunger in the forward and backward movement direction are respectively inserted, the pair of armatures being fixed to the plunger;

a yoke to which one of the pair of armatures becomes closer than the other when the plunger is at the first stop position;

a permanent magnet whose one magnetic pole makes contact with the yoke;

an auxiliary yoke which makes contact with the other magnetic pole of the permanent magnet, the auxiliary yoke becoming closer to the other of the pair of armatures than the one of the pair of armatures when the plunger is at the first stop position; and a gap maintaining portion configured to maintain a gap between the other of the pair of armatures and the auxiliary yoke when the plunger is at the first stop position, and wherein when the plunger is at the first stop position, the other of the pair of armatures and the auxiliary yoke comes close to each other with the gap therebetween, and a space is provided between the one of the pair of armatures and the yoke.

2. The remote control relay of claim 1, wherein the gap maintaining portion is a nonmagnetic plate which is provided between the other of the pair of armatures and the auxiliary yoke when the plunger is at the first stop position.

3. The remote control relay of claim 1, wherein the gap maintaining portion is a protrusion portion which protrudes from the coil frame toward the other of the pair of armatures when the plunger is at the first stop position.

* * * * *